US008282336B2

(12) United States Patent
Wadia et al.

(10) Patent No.: US 8,282,336 B2
(45) Date of Patent: Oct. 9, 2012

(54) INSTABILITY MITIGATION SYSTEM

(75) Inventors: Aspi Rustom Wadia, Loveland, OH (US); Seyed Gholamali Saddoughi, Clifton Park, NY (US); Clark Leonard Applegate, West Chester, OH (US)

(73) Assignee: General Electric Company, Schenectady, NY (US)

( * ) Notice: Subject to any disclaimer, the term of this patent is extended or adjusted under 35 U.S.C. 154(b) by 1319 days.

(21) Appl. No.: 11/966,416

(22) Filed: Dec. 28, 2007

(65) Prior Publication Data

US 2009/0169362 A1 Jul. 2, 2009

(51) Int. Cl.
*F01D 17/20* (2006.01)

(52) U.S. Cl. ..... 415/1; 415/914

(58) Field of Classification Search ..... 415/1, 914
See application file for complete search history.

(56) References Cited

U.S. PATENT DOCUMENTS

| | | | | |
|---|---|---|---|---|
| 2,594,042 | A | 4/1952 | Lee | |
| 3,300,121 | A | 1/1967 | Johnson | |
| 5,161,944 | A | 11/1992 | Wood | |
| 6,438,484 | B1 | 8/2002 | Andrew et al. | |
| 6,607,350 | B2 * | 8/2003 | Dodd | 415/14 |
| 6,666,017 | B2 | 12/2003 | Prentice et al. | |
| 6,715,984 | B2 * | 4/2004 | Nakajima et al. | 415/1 |
| 6,793,455 | B2 | 9/2004 | Prasad et al. | |
| 6,871,487 | B2 | 3/2005 | Kurtz et al. | |
| 6,973,771 | B2 | 12/2005 | Nottin | |
| 7,159,401 | B1 | 1/2007 | Kurtz et al. | |
| 7,334,394 | B2 | 2/2008 | Samimy et al. | |
| 7,588,413 | B2 | 9/2009 | Lee et al. | |
| 7,628,585 | B2 | 12/2009 | Lee et al. | |
| 7,695,241 | B2 | 4/2010 | Lee et al. | |
| 7,736,123 | B2 | 6/2010 | Lee et al. | |
| 7,766,599 | B2 | 8/2010 | Lee et al. | |
| 7,819,626 | B2 * | 10/2010 | Lee et al. | 415/173.2 |
| 7,870,720 | B2 | 1/2011 | Hagseth et al. | |
| 7,871,719 | B2 | 1/2011 | Houchin-Miller et al. | |
| 7,984,614 | B2 | 7/2011 | Nolcheff | |
| 8,006,497 | B2 | 8/2011 | Nolcheff et al. | |
| 2004/0011917 | A1 | 1/2004 | Saeks et al. | |

(Continued)

FOREIGN PATENT DOCUMENTS

DE 102006008864 2/2006

(Continued)

OTHER PUBLICATIONS

Corke, Thomas C., et al., "Overview of Plasma Flow Control: Concepts, Optimization, and Applications", 43rd AIAA Aerospace Science Meeting and Exhibit, Jan. 10-13, 2005, Reno, Nevada, AIAA 2005-563, American Institute of Aeronautics and Astronauts, Inc.

(Continued)

*Primary Examiner* — Dwayne J White
(74) *Attorney, Agent, or Firm* — General Electric Company; Matthew P. Hayden; David J. Clement

(57) ABSTRACT

An instability mitigation system is disclosed, comprising a detection system for detecting an onset of an instability in a rotor during the operation of the rotor, a mitigation system that facilitates the improvement of the stability of the rotor when the onset of instability is detected by the detection system, a control system for controlling the detection system and the mitigation system.

12 Claims, 10 Drawing Sheets

U.S. PATENT DOCUMENTS

| | | | | |
|---|---|---|---|---|
| 2008/0089775 | A1 | 4/2008 | Lee et al. | |
| 2008/0101913 | A1 | 5/2008 | Lee et al. | |
| 2008/0128266 | A1 | 6/2008 | Lee et al. | |
| 2008/0131265 | A1 | 6/2008 | Lee et al. | |
| 2008/0145210 | A1 | 6/2008 | Lee et al. | |
| 2008/0145233 | A1 | 6/2008 | Lee et al. | |
| 2009/0065064 | A1* | 3/2009 | Morris et al. | 137/2 |
| 2009/0169356 | A1 | 7/2009 | Wadia et al. | |
| 2009/0169363 | A1 | 7/2009 | Wadia et al. | |
| 2009/0169367 | A1 | 7/2009 | Wadia et al. | |
| 2010/0047055 | A1 | 2/2010 | Wadia et al. | |
| 2010/0047060 | A1 | 2/2010 | Wadia et al. | |
| 2010/0170224 | A1 | 7/2010 | Clark et al. | |
| 2010/0172747 | A1 | 7/2010 | Clark et al. | |
| 2010/0284780 | A1 | 11/2010 | Wadia et al. | |
| 2010/0284785 | A1 | 11/2010 | Wadia et al. | |
| 2010/0284786 | A1 | 11/2010 | Wadia et al. | |
| 2010/0284795 | A1 | 11/2010 | Wadia et al. | |

FOREIGN PATENT DOCUMENTS

| | | |
|---|---|---|
| EP | 1329595 | 7/2003 |
| EP | 1413713 | 4/2004 |
| EP | 1607574 | 12/2005 |
| EP | 1672966 | 6/2006 |
| EP | 1906136 | 4/2008 |
| EP | 1908927 | 4/2008 |
| EP | 1914385 | 4/2008 |
| EP | 1914391 | 4/2008 |
| EP | 1918520 | 5/2008 |
| EP | 1926353 | 5/2008 |
| EP | 1936116 | 6/2008 |
| EP | 1936117 | 6/2008 |
| FR | 1031925 | 6/1953 |
| GB | 2191606 | 4/1987 |
| JP | 2008-270110 | 6/2008 |
| WO | 9403862 | 2/1994 |
| WO | 9935893 | 7/1999 |
| WO | 03038282 | 5/2003 |
| WO | 2005114013 | 12/2005 |
| WO | 2008154592 | 12/2008 |
| WO | 2009018532 | 2/2009 |

OTHER PUBLICATIONS

Opaits, D.F., et al., "Plasma Control of Boundary Layer Using Low-Temperature Non-Equilibrium Plasma of Gas Discharge", 43rd AIAA Aerospace Science Meeting and Exhibit, Jan. 10-13, 2005, Reno, Nevada, AIAA 2005-1180, American Institute of Aeronautics and Astronauts, Inc.

Hultgren, Lennart S., et al., "Demonstration of Separation Delay With Glow-Discharge Plasma Actuators", 41st AIAA Aerospace Science Meeting and Exhibit, Jan. 6-9, 2003, Reno, Nevada, AIAA 2003-1025, American Institute of Aeronautics and Astronauts, Inc.

Huang, Junhui, et al, "Unsteady Plasma Actuators for Separation Control of Low-Pressure Turbine Blades", AIAA Journal, vol. 44, No. 7, Jul. 2006, pp. 1147-1157, American Institute of Aeronautics and Astronauts, Inc.

Rivir, R.B., et al., "Control of Separation in Turbine Boundary Layers", 2nd AIAA Flow Control Conference, Jun. 28-Jul. 1, 2004, Portland, Oregon, AIAA 2004-2201, American Institute of Aeronautics and Astronauts, Inc.

Corke, Thomas C., et al., "Plasma Flow Control Optimized Airfoil", 44th AIAA Aerospace Sciences Meeting and Exhibit, Jan. 9-12, 2006, Reno, Nevada, AIAA 2006-1208, American Institute of Aeronautics and Astronauts, Inc.

Visbal, Miguel R., et al., "Control of Transitional and Turbulent Flows Using Plasma-Based Actuators", 36th AIAA Fluid Dynamics Conference and Exhibit, Jun. 5-8, 2006, San Francisco, California, AIAA 2006-3230, American Institute of Aeronautics and Astronauts, Inc.

Rivir, R., et al., "AC and Pulsed Plasma Flow Control", 42nd AIAA Aerospace Sciences Meeting and Exhibit, Jan. 5-8, 2004, Reno, Nevada, AIAA 2004-847, American Institute of Aeronautics and Astronauts, Inc.

Balcer, Brian E., et al., "Effects of Plasma Induced Velocity on Boundary Layer Flow", 44th AIAA Aerospace Sciences Meeting and Exhibit, Jan. 9-12, 2006, Reno, Nevada, AIAA 2006-875, American Institute of Aeronautics and Astronauts, Inc.

Santhanakrishnan, Arvind, et al., "Flow Control Using Plasma Actuators and Linear/Annular Plasma Synthetic Jet Actuators", 3rd AIAA Flow Control Conference, Jun. 5-8, 2006, San Francisco, California, AIAA 2006-3033, American Institute of Aeronautics and Astronauts, Inc.

Jukes, Timothy N., et al., "Turbulent Drag Reduction by Surface Plasma through Spanwise Flow Oscillation", 3rd AIAA Flow Control Conference, Jun. 5-8, 2006, San Francisco, California, AIAA 2006-3693, American Institute of Aeronautics and Astronauts, Inc.

Christensen, D. et al., "Development and Demonstration of a Stability Management System for Gas Turbine Engines," Proceedings of GT2006, ASME Turbo Expo 2006: Power for Land, Sea and Air, Barcelona, Spain, GT2006-90324, (May 8-11, 2006).

Wikipedia Contributors: "Dielectric barrier discharge"; Internet Citation, [online] p. 1, XP007907353; retrieved from the Internet: URL:http://en.wikipedia.org/w/index.php?title=Dielectric_barrier_discharge&oldid=255196896>[retrieved on Jan. 1, 2009].

Wikipedia Contributors: "Plasma (physics)"; Internet Citation, [online] pp. 1-16, XP007907356; retrieved from the Internet: URL:http://en.wikipedia.org/w/index.php?title=Plasma_physics &oldid=2729329>[retrieved on Feb. 24, 2009].

Goksel, B. et al, "Active Flow Control, in Turbomachinery Using Phased Plasma Actuators", Internet Citation, [online] Apr. 1, 2004; XP007907306; retrieved from the Internet: URL:http://www.electrofluidsystems.com/news/goksel-ISABE2005.pdf>[retrieved on Feb. 19, 2009].

Patel, M.P. et al., "Autonomous Sensing and Control of Wing Stall Using a Smart Plasma Slat"; Journal of Aircraft; vol. 44, No. 2, Mar.-Apr. 2007.

Vo, H.D., "Control of Rotating Stall in Axial Compressors Using Plasma Actuators"; Ecole Polytechnique de Montreal, Montreal, Canada; AIAA 2007-3845; pp. 1-15.

Wu, Y. et al., "Experimental investigation of using plasma aerodynamic actuation to extend low-speed axial compressor's stability"; Hangkong-Dongli-Xuebao:Jikan=Journal of Aerospace Power, Beijing Hangkong Xueyuan Chubanshe, Beijing, vol. 22, No. 12, Dec. 1, 2007, pp. 2025-2030, XP009112656; ISSN: 100-8055.

Corke, T.C., et al., "SDBD plasma enhanced aerodynamics: concepts, optimization and applications"; Progress in Aerospace Sciences 43 (2007); pp. 193-217; Hessert Laboratory for Aerospace Research, Center for Flow Physics and Control, University of Notre Dame, Notre Dame, IN 46556, USA.

Van Ness II, D.K. et al., "Stereo PIV of a Turbine Tip Clearance Flow with Plasma Actuation", AIAA paper 2006-21, Jan. 1, 2006, pp. 1-11, XP009112404.

Vo, H.D., "Suppression of Short Length-Scale Rotating Stall Inception With Glow Discharge Actuation"; ASME Turbo Expo 2007; Power for Land, Sea and Air; May 14-17, 2007, Montreal, Canada; Ecole Polytechnique de Montreal Department of Mechanical Engineering; Montreal, Quebec, Canada; pp. 267-278; Copyright 2007 by ASME.

Morris, S.C., et al.; "Tip Clearance Control Using Plasma Actuators"; 43rd AIAA Aerospace Sciences Meeting and Exhibit, Jan. 10-13, 2005, Reno, Nevada; AIAA 2005-782; pp. 1-8.

Douville, T. et al., "Turbine Blade Tip Leakage Flow Control by Partial Squealer Tip and Plasma Actuators"; AIAA Aerospace Sciences Meeting, vol. AIAA 2006-20; Jan. 1, 2006; pp. 263-280.

Van Ness II, D.K. et al., "Turbine Tip Clearance Flow Control using Plasma Actuation", AIAA paper 2006-21, Jan. 1, 2006, pp. 1-11, XP009112404.

International Search Report mailed Mar. 17, 2009 for corresponding Application No. PCT/US2008/088355.

Written Opinion mailed Mar. 17, 2009 for corresponding Application No. PCT/US2008/088355.

International Search Report mailed Mar. 17, 2009 for corresponding Application No. PCT/US2008/088182.

Written Opinion mailed Mar. 17, 2009 for corresponding Application No. PCT/US2008/088182.

"Overview of Plasma Flow Control: Concepts, Optimization, and Applications", thomas C. Corke and Martiqua L. Post, 43rd AIAA Aerospace Science Meeting and Exhibit, Jan. 10-13, 2005, Reno, Nevada, AIAA 2005-563, 15 pages.
"Plasma Control Of Boundary Layer Using Low-Temperature Non-Equilibrium Plasma Of Gas Discharge", D.F. Opaits, D.V. Roupassov, S. M. Starikovskaia, A.Yu. Starikovskii, I.N. Zavialov, and S.G. Saddoughi, 43rd AIAA Aerospace Sciences Meeting and Exhibit, Jan. 10-13, 2005, Reno, Nevada, AIAA 2005-1180, 6 pages.
"Demonstration Of Separation Delay With Glow-Discharge Plasma Actuators", Lennart S. Hultgren and David E. Ashpis, 41st AIAA Aerospace Sciences Meeting and Exhibit, Jan. 6-9, 2003, Reno, Nevada, AIAA 2003-1025, 10 pages.
Unsteady Plasma Actuators for Separation Control of Low-Pressure Turbine Blades:, Junhui Huang, Thomas C. Corke and Flint O. Thomas, AIAA Journal, vol. 44, No. 7, Jul. 2006, pp. 1477-1487.
"Control of Separation in Turbine Boundary Layers", R.B. Rivir, R. Sondergaard, J.P. Bons, and N. Yurchenko, 2nd AIAA Flow Control Conference, Jun. 28-Jul. 1, 2004, Portland, Oregon, 16 pages.
"Plasma Flow Control Optimized Airfoil", Thomas C. Corke, Benjamin Mertz, and Mehul P. Patel, 44th AIAA Aerospace Sciences Meeting and Exhibit, Jan. 9-12, 2006, Reno, Nevada, AIAA 2006-1208, 13 pages.
"Control of Transitional and Turbulent Flows Using Plasma-Based Actuators", Miguel R. Visbal, Datta V. Gaitonde, and Subrata Roy, 36th AIAA Fluid Dynamics Conference and Exhibit, Jun. 5-8, 2006, San Francisco California, AIAA 2006-3230, 22 pages.
"AC and Pulsed Plasma Flow Control", R. Rivir, A. White, C. Carter, B. Ganguly, J. Jacob, A. Forelines, and J. Crafton, 42nd AIAA Aerospace Sciences Meeting and Exhibit, Jan. 5-8, 2004, Reno, Nevada, AIAA 2004-847, 9 pages.
"Effects Of Plasma Induced Velocity on Boundary Layer Flow" Brian E. Balcer, Milton E. Franke, and Richard B. Rivir, 44th AIAA Aerospace Sciences Meeting and Exhibit, Jan. 9-12, 2006, Reno, Nevada, AIAA 2006-875, 12 pages.
"Flow Control Using Plasma Actuators and Linear/Annular Plasma Synthetic Jet Actuators", Arvind Santhanakrishan, Jamey D. Jacov, and Yildirim B. Suzen, 3rd AIAA Flow Control Conference, Jun. 5-8, 2006, San Francisco, California, AIAA 2006-3033, 31 pages.
"Turbulent Drag Reduction by Surface Plasma through Spanwise Flow Oscillation", Timothy N. Jukes, Kwing-So Choi, Graham A. Johnson, and Simon J. Scott, 3rd AIAA Flow Control Conference, Jun. 5-8, 2006, San Francisco, California, AIAA 2006-3693, 14 pages.
D. Christensen, P. Cantin, D. Gutz, P.N. Szucs, A.R.Wadia, J. Armor, M.Dhingra, Y.Neumeier and J.V.R.Prasad; "Development and Demonstration of a Stability Management System For Gas Turbine Engines", Proceedings of GT 2006 ASME Turbo Expo 2006, May 8-11, 2006, Barcelona, Spain, GT2006-90324.

* cited by examiner

INSTABILITY MITIGATION SYSTEM

BACKGROUND OF THE INVENTION

This invention relates generally to gas turbine engines, and, more specifically, to a system for detection of an instability such as a stall in a compression system such as a fan or a compressor used in a gas turbine engine.

In a turbofan aircraft gas turbine engine, air is pressurized in a compression system, comprising a fan module, a booster module and a compression module during operation. In large turbo fan engines, the air passing through the fan module is mostly passed into a by-pass stream and used for generating the bulk of the thrust needed for propelling an aircraft in flight. The air channeled through the booster module and compression module is mixed with fuel in a combustor and ignited, generating hot combustion gases which flow through turbine stages that extract energy therefrom for powering the fan, booster and compressor rotors. The fan, booster and compressor modules have a series of rotor stages and stator stages. The fan and booster rotors are typically driven by a low pressure turbine and the compressor rotor is driven by a high pressure turbine. The fan and booster rotors are aerodynamically coupled to the compressor rotor although these normally operate at different mechanical speeds.

Operability in a wide range of operating conditions is a fundamental requirement in the design of compression systems, such as fans, boosters and compressors. Modern developments in advanced aircrafts have required the use of engines buried within the airframe, with air flowing into the engines through inlets that have unique geometries that cause severe distortions in the inlet airflow. Some of these engines may also have a fixed area exhaust nozzle, which limits the operability of these engines. Fundamental in the design of these compression systems is efficiency in compressing the air with sufficient stall margin over the entire flight envelope of operation from takeoff, cruise, and landing. However, compression efficiency and stall margin are normally inversely related with increasing efficiency typically corresponding with a decrease in stall margin. The conflicting requirements of stall margin and efficiency are particularly demanding in high performance jet engines that operate under challenging operating conditions such as severe inlet distortions, fixed area nozzles and increased auxiliary power extractions, while still requiring high a level of stability margin throughout the flight envelope.

Instabilities, such as stalls, are commonly caused by flow breakdowns at the tip of the rotor blades of compression systems such as fans, compressors and boosters. In gas turbine engine compression system rotors, there are tip clearances between rotating blade tips and a stationary casing or shroud that surrounds the blade tips. During the engine operation, air leaks from the pressure side of a blade through the tip clearance toward the suction side. These leakage flows may cause vortices to form at the tip region of the blade. A tip vortex can grow and spread when there are severe inlet distortions in the air flowing into compression system, or when the engine is throttled, and lead to a compressor stall and cause significant operability problems and performance losses.

Accordingly, it would be desirable to have the ability to measure and control dynamic processes such as flow instabilities in compression systems. It would be desirable to have a detection system that can measure a compression system parameter related to the onset of flow instabilities, such as the dynamic pressure near the blade tips, and process the measured data to detect the onset of an instability such as a stall in compression systems, such as fans, boosters and compressors. It would be desirable to have a mitigation system to mitigate compression system instabilities based on the detection system output, for certain flight maneuvers at critical points in the flight envelope, allowing the maneuvers to be completed without instabilities such as stalls and surges. It would be desirable to have an instability mitigation system that can control and manage the detection system and the mitigation system.

BRIEF DESCRIPTION OF THE INVENTION

The above-mentioned need or needs may be met by exemplary embodiments which provide a compression system the compression system comprising a rotor having a circumferential row of blades each blade having a blade tip, a static component located radially outwardly and apart from the blade tips, a detection system for detecting an instability in the rotor during the operation of the rotor, and a mitigation system that facilitates the improvement of the stability of the rotor when an instability is detected by the detection system.

In one exemplary embodiment, a gas turbine engine comprising a fan section, a detection system for detecting an instability during the operation of the fan section and a mitigation system that facilitates the improvement of the stability of the fan section is disclosed.

In another exemplary embodiment, a detection system is disclosed for detecting onset of an instability in a multi-stage compression system rotor comprising a pressure sensor located on a casing surrounding tips of a row of rotor blades wherein the pressure sensor is capable of generating an input signal corresponding to the dynamic pressure at a location near the rotor blade tip.

In another exemplary embodiment, a mitigation system is provided to mitigate compression system instabilities for increasing the stable operating range of a compression system, the system comprising at least one plasma generator located on a static component surrounding the tips of the compression system blades. The plasma generator comprises a first electrode and a second electrode separated by a dielectric material. The plasma generator is operable for forming a plasma between first electrode and the second electrode.

In another exemplary embodiment, the plasma actuator has an annular configuration. In another exemplary embodiment the plasma actuator system comprises a discrete plasma generator.

BRIEF DESCRIPTION OF THE DRAWINGS

The subject matter which is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
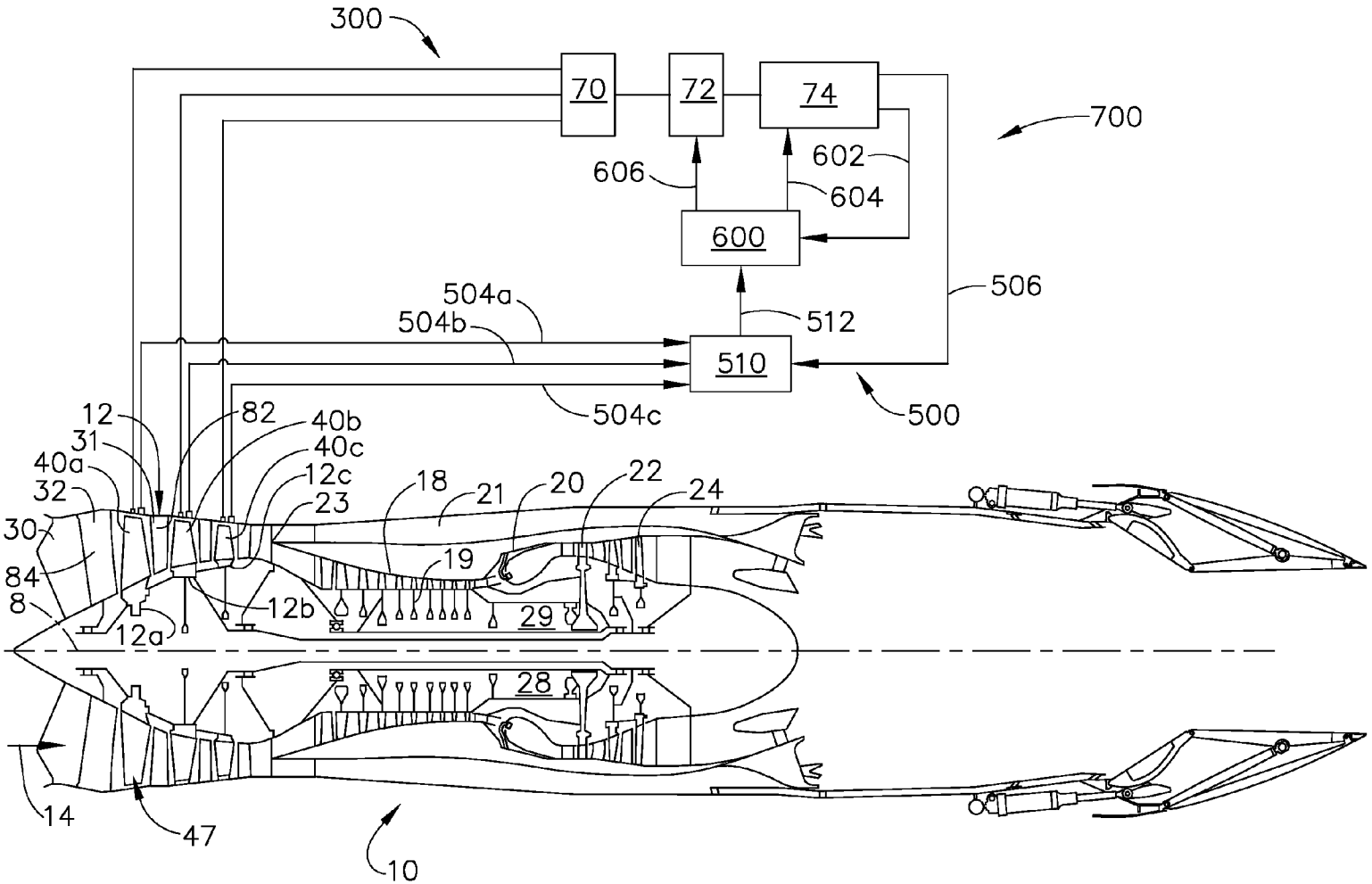
FIG. 1 is a schematic cross-sectional view of a gas turbine engine with an exemplary embodiment of the present invention.

Referring to the drawings wherein identical reference numerals denote the same elements throughout the various views, FIG. 1 shows an exemplary turbofan gas turbine engine 10 incorporating an exemplary embodiment of the present invention. It comprises an engine centerline axis 8, fan section 12 which receives ambient air 14, a high pressure compressor (HPC) 18, a combustor 20 which mixes fuel with the air pressurized by the HPC 18 for generating combustion gases or gas flow which flows downstream through a high pressure turbine (HPT) 22, and a low pressure turbine (LPT) 24 from which the combustion gases are discharged from the engine 10. Many engines have a booster or low pressure compressor (not shown in FIG. 1) mounted between the fan section and the HPC. A portion of the air passing through the fan section 12 is bypassed around the high pressure compressor 18 through a bypass duct 21 having an entrance or splitter 23 between the fan section 12 and the high pressure compressor 18. The HPT 22 is joined to the HPC 18 to substantially form a high pressure rotor 29. A low pressure shaft 28 joins the LPT 24 to the fan section 12 and the booster if one is used. The second or low pressure shaft 28 is rotatably disposed co-axially with and radially inwardly of the first or high pressure rotor. In the exemplary embodiments of the present invention shown in FIGS. 1 and 2, the fan section 12 has a multi-stage fan rotor, as in many gas turbine engines, illustrated by first, second, and third fan rotor stages 12*a*, 12*b*, and 12*c* respectively.

The fan section 12 that pressurizes the air flowing through it is axisymmetrical about the longitudinal centerline axis 8. The fan section 12 includes a plurality of inlet guide vanes (IGV) 30 and a plurality of stator vanes 31 arranged in a circumferential direction around the longitudinal centerline axis 8. The multiple, rotor stages 12*a*, 12*b*, 12*c* of the fan section 12 have corresponding fan rotor blades 40*a*, 40*b*, 40*c* extending radially outwardly from corresponding rotor hubs 39*a*, 39*b*, 39*c* in the form of separate disks, or integral blisks, or annular drums in any conventional manner.

Figure 2:
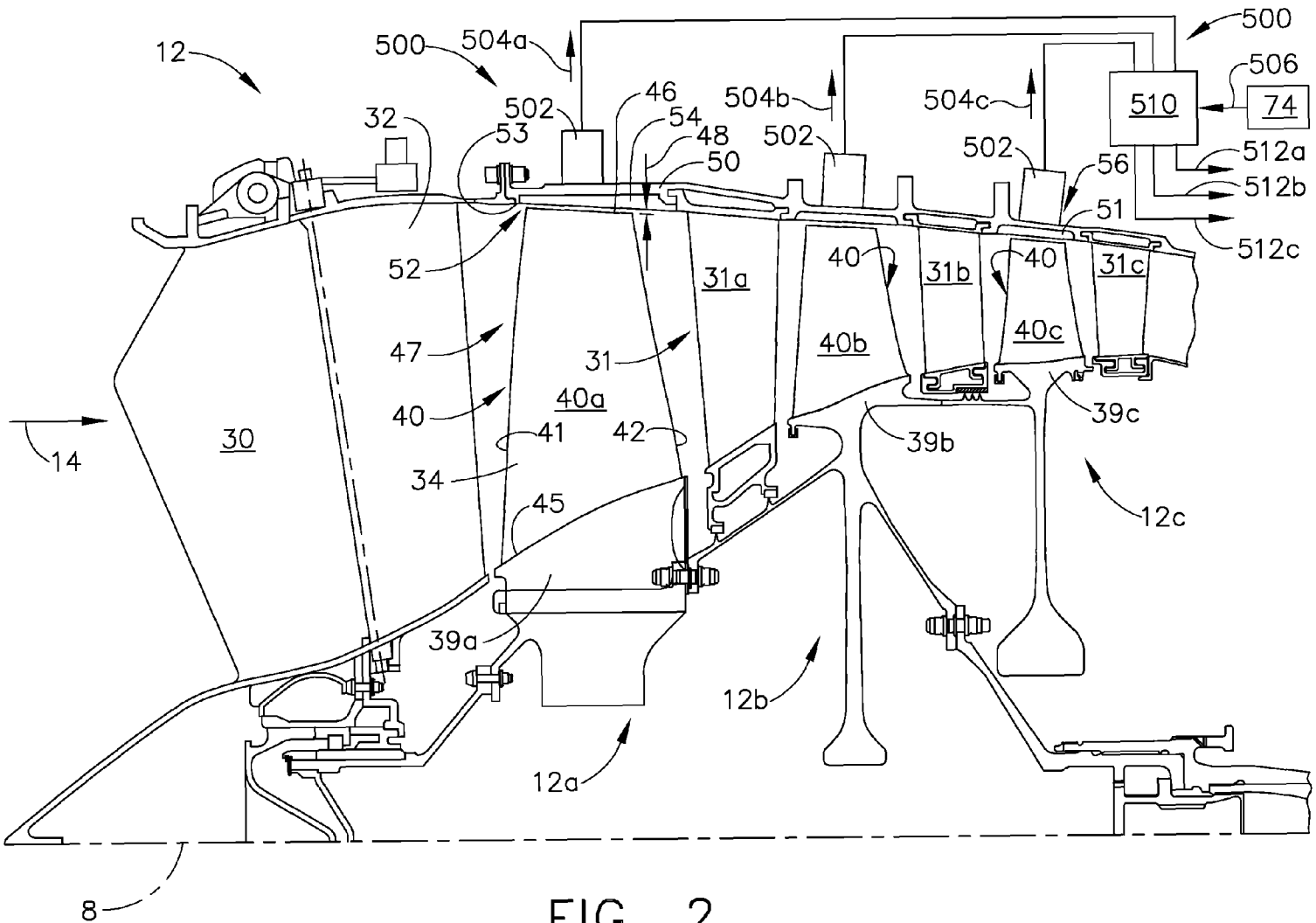
FIG. 2 is an enlarged cross-sectional view of a portion of the fan section of the gas turbine engine shown in FIG. 1.

Cooperating with a fan rotor stage 12*a*, 12*b*, 12*c* is a corresponding stator stage 31 comprising a plurality of circumferentially spaced apart stator vanes 31*a*, 31*b*, 31*c*. An exemplary arrangement of stator vanes and rotor blades is shown in FIG. 2. The rotor blades 40 and stator vanes 31*a*, 31*b*, 31*c* have airfoils having corresponding aerodynamic profiles or contours for pressurizing the airflow successively in axial stages. Each fan rotor blade 40 comprises an airfoil 34 extending radially outward from a blade root 45 to a blade tip 46, a concave side (also referred to as "pressure side") 43, a convex side (also referred to as "suction side") 44, a leading edge 41 and a trailing edge 42. The airfoil 34 extends in the chordwise direction between the leading edge 41 and the trailing edge 42. A chord C of the airfoil 34 is the length between the leading 41 and trailing edge 42 at each radial cross section of the blade. The pressure side 43 of the airfoil 34 faces in the general direction of rotation of the fan rotors and the suction side 44 is on the other side of the airfoil.

A stator stage 31 is located in axial proximity to a rotor, such as for example item 12*b*. Each stator vane, such as shown as items 31*a*, 31*b*, 31*c* in FIG. 2, in a in a stator stage 31 comprises an airfoil 35 extending radially in a generally span wise direction corresponding to the span between the blade root 45 and the blade tip 46. Each stator vane, such as item 31*a*, has a vane concave side (also referred to as "pressure side") 57, a vane convex side (also referred to as "suction side") 58, a vane leading edge 36 and a vane trailing edge 37. The vane airfoil 35 extends in the chordwise direction between the leading edge 36 and the trailing edge 37. A chord of the airfoil 35 is the length between the leading 36 and trailing edge 37 at each radial cross section of the stator vane. At the front of the compression system, such as the fan section 12, is a stator stage having a set of inlet guide vanes 30 ("IGV") that receive the airflow into the compression system. The inlet guide vanes 30 have a suitably shaped aerodynamic profile to guide the airflow into the first stage rotor 12*a*. In order to suitably orient the airflow into the compression system, the inlet guide vanes 30 may have IGV flaps 32 that are moveable, located near their aft end. The IGV flap 32 is shown in FIG. 2 at the aft end of the IGV 30. It is supported between two hinges at the radially inner end and the outer end such that it is can be moved during the operation of the compression system.

The rotor blades rotate within a static structure, such as a casing or a shroud, that are located radially apart from and surrounding the blade tips, as shown in FIG. 2. The front stage rotor blades 40 rotate within an annular casing 50 that surrounds the rotor blade tips. The aft stage rotor blades of a multi stage compression system, such as the high pressure compressor shown as item 18 in FIG. 1, typically rotate within an annular passage formed by shroud segments 51 that are circumferentially arranged around the blade tips 46. In operation, pressure of the air is increased as the air decelerates and diffuses through the stator and rotor airfoils.

Figure 3:
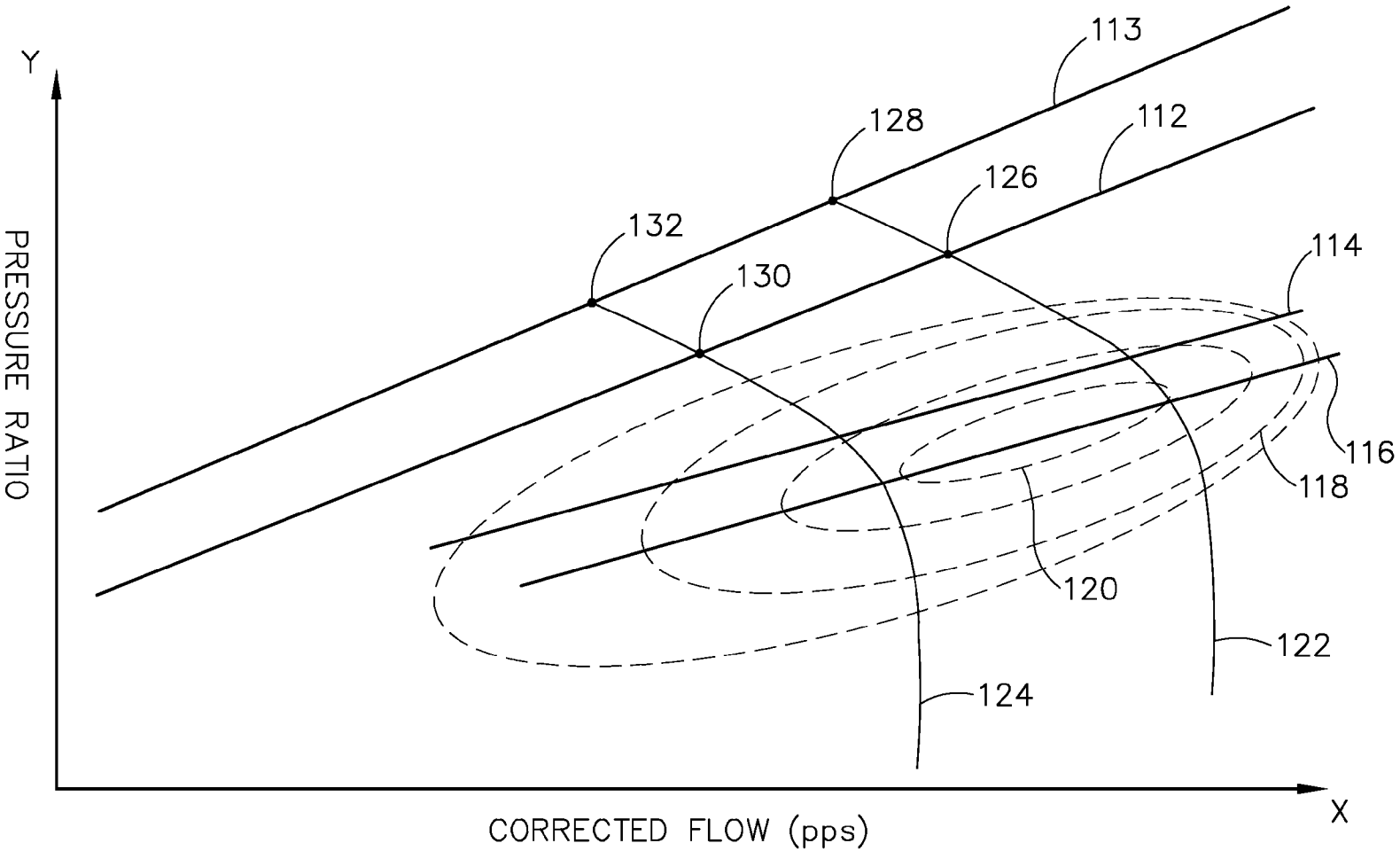
FIG. 3 is an exemplary operating map of a compression system in the gas turbine engine shown in FIG. 1.

Operating map of an exemplary compression system, such as the fan section 12 in the exemplary gas turbine engine 10 is shown in FIG. 3, with inlet corrected flow rate along the horizontal axis and the pressure ratio on the vertical axis. Exemplary operating lines 114, 116 and the stall line 112 are shown, along with exemplary constant speed lines 122, 124. Line 124 represents a lower speed line and line 122 represents a higher speed line. As the compression system is throttled at a constant speed, such as constant speed line 124, the inlet corrected flow rate decreases while the pressure ratio increases, and the compression system operation moves closer to the stall line 112. Each operating condition has a corresponding compression system efficiency, conventionally defined as the ratio of ideal (isentropic) compressor work input to actual work input required to achieve a given pressure ratio. The compressor efficiency of each operating condition is plotted on the operating map in the form of contours of constant efficiency, such as items 118, 120 shown in FIG. 3. The performance map has a region of peak efficiency, depicted in FIG. 3 as the smallest contour 120, and it is desirable to operate the compression systems in the region of peak efficiency as much as possible. Flow distortions in the inlet air flow 14 which enters the fan section 12 tend to cause flow instabilities as the air is compressed by the fan blades (and compression system blades) and the stall line 112 will tend to drop lower. As explained further below herein, the exemplary embodiments of the present invention provide a system for detecting the flow instabilities in the fan section 12, such as from flow distortions, and processing the information from the fan section to predict an impending stall in a fan rotor. The embodiments of the present invention shown herein enable other systems in the engine which can respond as necessary to manage the stall margin of fan rotors and other compression systems by raising the stall line, as represented by item 113 in FIG. 3.

Figure 4C:
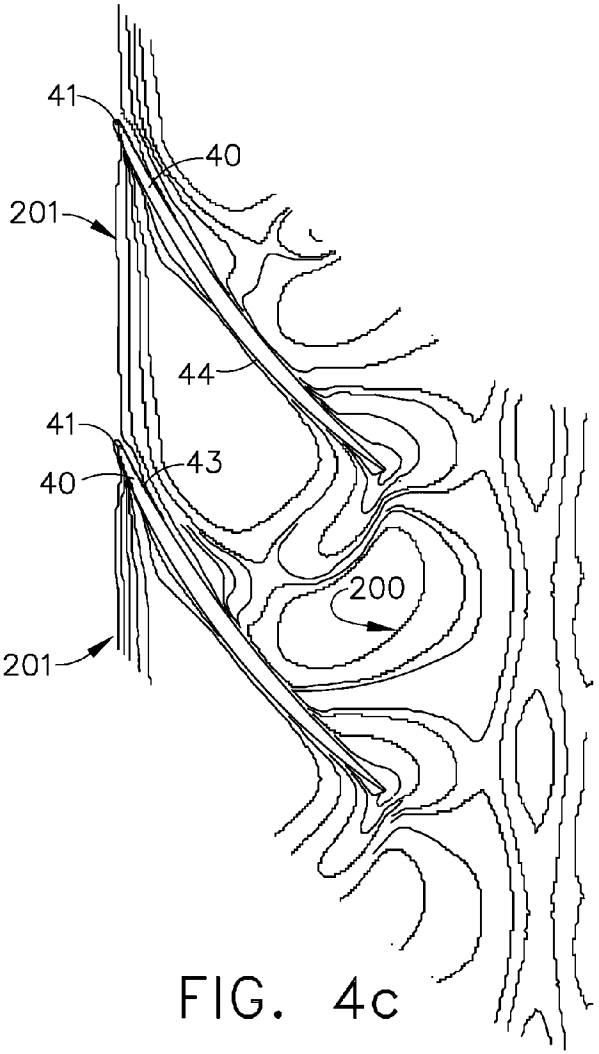
FIG. 4*c* shows the reversed flow in the vortex at the blade tip region during a stall.
Figure 4B:
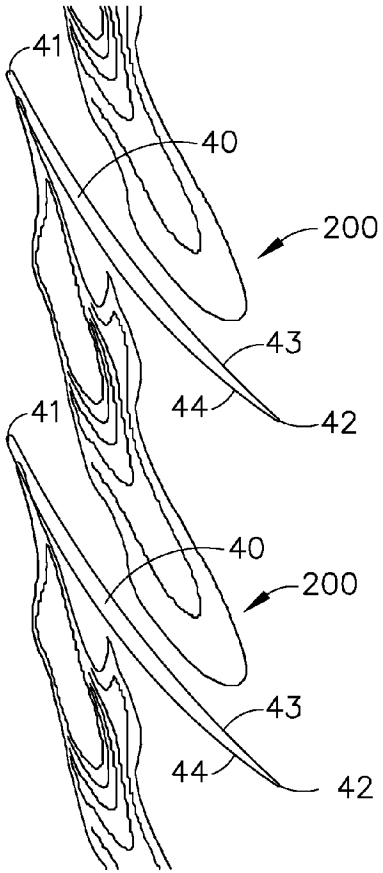
FIG. 4*b* shows the spread of the region of reversed flow in the blade tip vortex shown in FIG. 4*a* as the compressor is throttled above the operating line.

Stalls in fan rotors due to inlet flow distortions, and stalls in other compression systems that are throttled, are known to be caused by a breakdown of flow in the tip region 52 of rotors, such as the fan rotors 12*a*, 12*b*, 12*c* shown in FIG. 2. This tip flow breakdown is associated with tip leakage vortex schematically shown in FIGS. 4*a*, 4*b* and 4*c* as contour plots of regions having a negative axial velocity, based from computational fluid dynamic analyses. Tip leakage vortex 200 initiates primarily at the rotor blade tip 46 near the leading edge 41. In the region of this vortex 200, there exists flow that has negative axial velocity, that is, the flow in this region is counter to the main body of flow and is highly undesirable. Unless interrupted, the tip vortex 200 propagates axially aft and tangentially from the blade suction surface 44 to the adjacent blade pressure surface 43 as shown in FIG. 4*b*. When it reaches the pressure surface 43, the flow tends to collect in a region of blockage at the tip between the blades as shown in FIG. 4*c* and causes high loss. As the inlet flow distortions become severe, or as a compression system is throttled, the blockage becomes increasingly larger within the flow passage between the adjacent blades and eventually becomes so large as to drop the rotor pressure ratio below its design level, and causes the fan rotor to stall. Near stall, the behavior of the blade passage flow field structure, specifically the blade tip clearance vortex trajectory, is perpendicular to the axial direction wherein the tip clearance vortex 200 spans the leading edges 41 of adjacent blades 40, as shown in FIG. 4*c*, item 201. The vortex 200 starts from the leading edge 41 on the suction surface 44 of the blade 40 and moves towards the leading edge 41 on the pressure side of the adjacent blade 40 as shown in FIG. 4*c*.

The ability to control a dynamic process, such as a flow instability in a compression system, requires a measurement of a characteristic of the process using a continuous measurement method or using samples of sufficient number of discrete measurements. In order to mitigate fan stalls for certain flight maneuvers at critical points in the flight envelope where the stability margin is small or negative, a flow parameter in the engine is first measured that can be used directly or, with some additional processing, to predict the onset of stall of a stage of a multistage fan shown in FIG. 2.

FIG. 2 shows an exemplary embodiment of a system 500 for detecting the onset of an aerodynamic instability, such as a stall or surge, in a compression stage in a gas turbine engine 10. In the exemplary embodiment shown in FIG. 2, a fan section 12 is shown, comprising a three stage fan having rotors, 12*a*, 12*b* and 12*c*. The embodiments of the present invention can also be used in a single stage fan, or in other compression system in a gas turbine engine, such as a high pressure compressor 18 or a low pressure compressor or a booster. In the exemplary embodiments shown herein, a pressure sensor 502 is used to measure the local dynamic pressure near the tip region 52 of the fan blade tips 46 during engine operation. Although a single sensor 502 can be used for the flow parameter measurements, use of at least two sensors 502 is preferred, because some sensors may become inoperable during extended periods of engine operations. In the exemplary embodiment shown in FIG. 2, multiple pressure sensors 502 are used around the tips of fan rotors 12*a*, 12*b*, and 12*c*.

Figure 5:
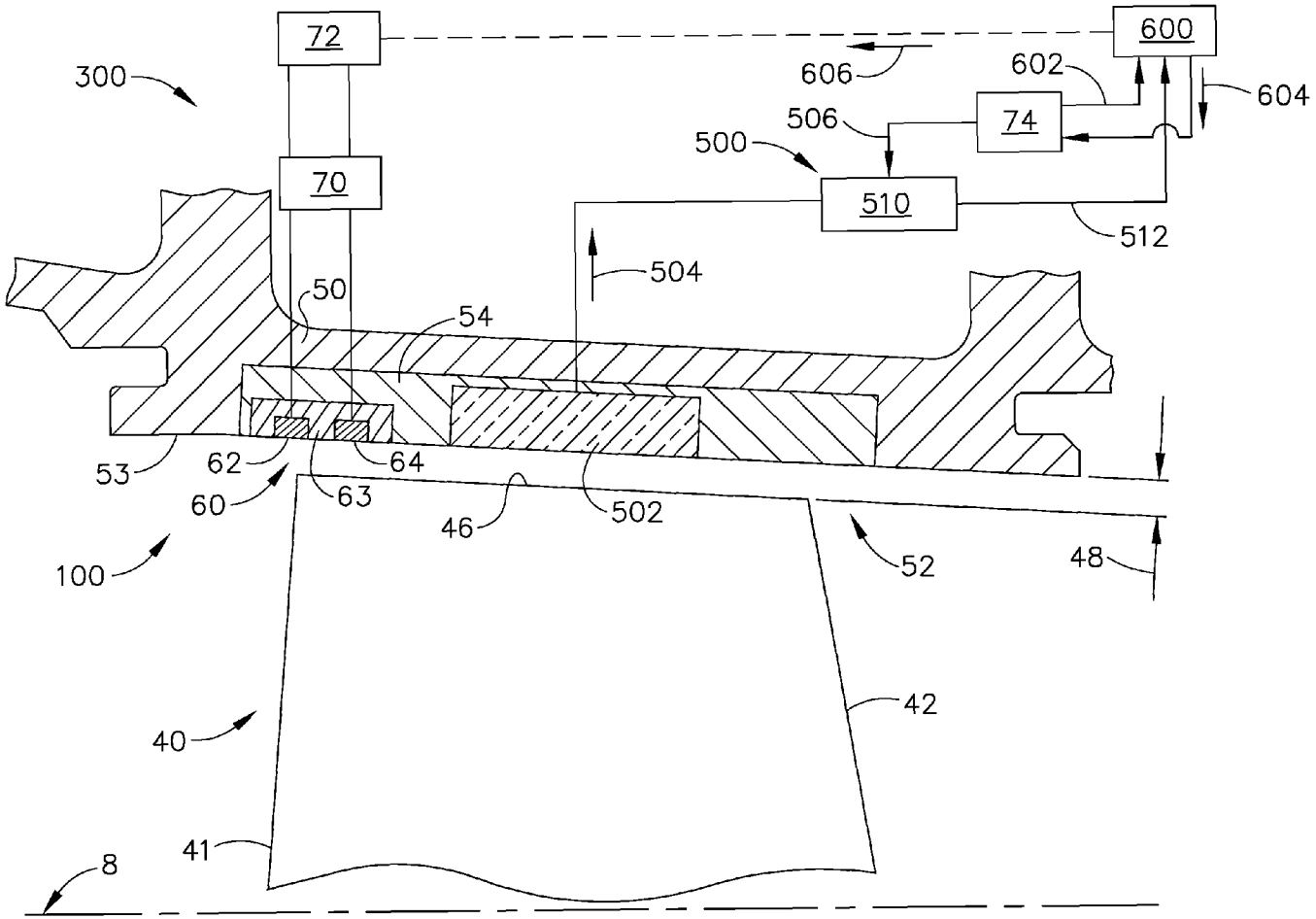
FIG. 5 is a schematic sketch of an exemplary arrangement of a sensor in an instability detection system and a plasma actuator in mitigation system.
Figure 7:
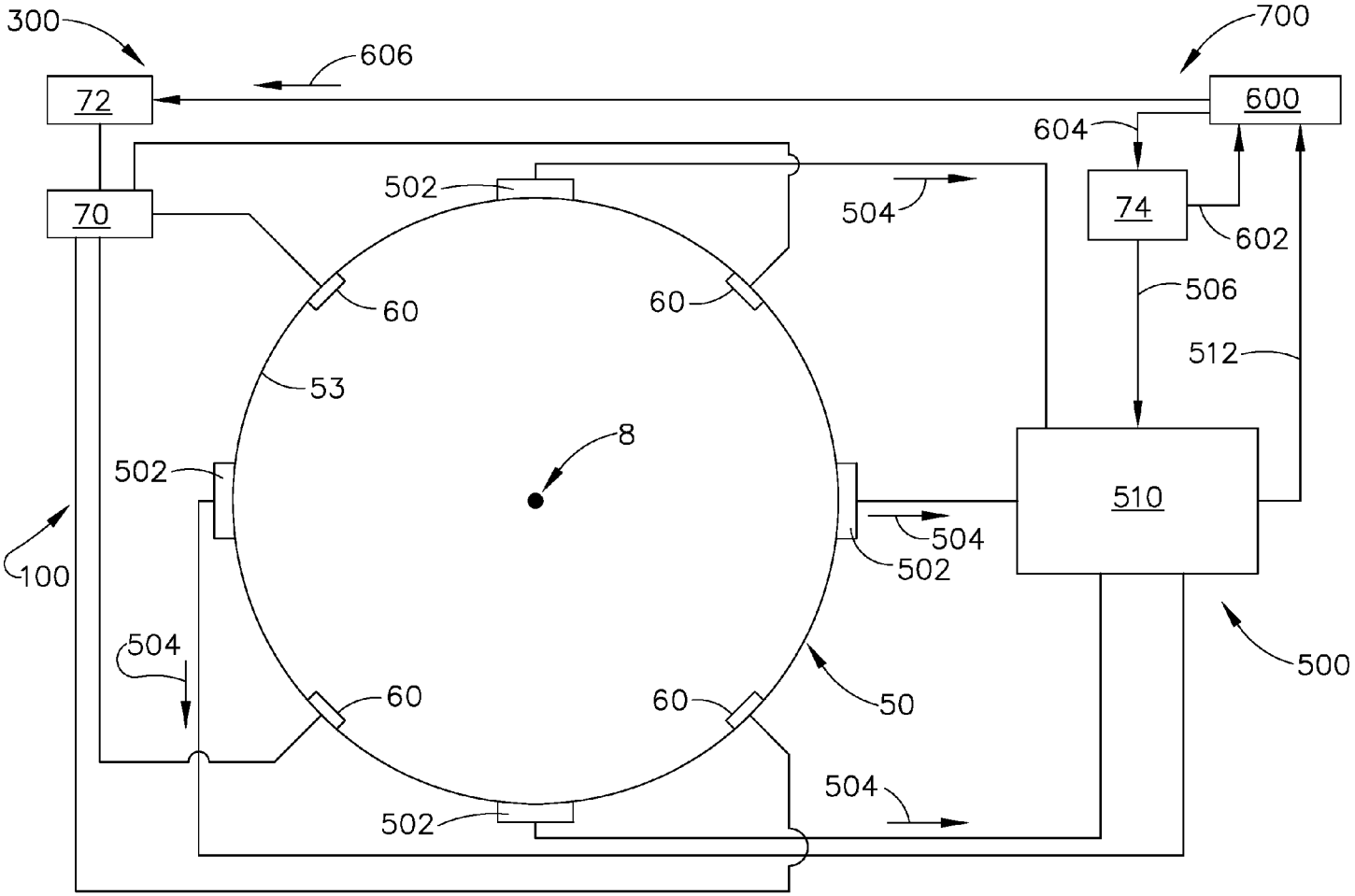
FIG. 7 is a schematic sketch of an exemplary arrangement of multiple sensors and plasma actuators in an instability mitigation system.

In the exemplary embodiment shown in FIG. 5, the pressure sensor 502 is located on a casing 50 that is spaced radially outwardly and apart from the fan blade tips 46. Alternatively, the pressure sensor 502 may be located on a shroud 51 (see FIG. 10) that is located radially outwardly and apart from the blade tips 46. The casing 50, or a plurality of shrouds 51, surrounds the tips of a row of blades 47. The pressure sensors 502 are arranged circumferentially on the casing 50 or the shrouds 51, as shown in FIG. 7. In an exemplary embodiment using multiple sensors on a rotor stage, the sensors 502 are arranged in substantially diametrically opposite locations in the casing or shroud, as shown in FIG. 7.

Figure 6:
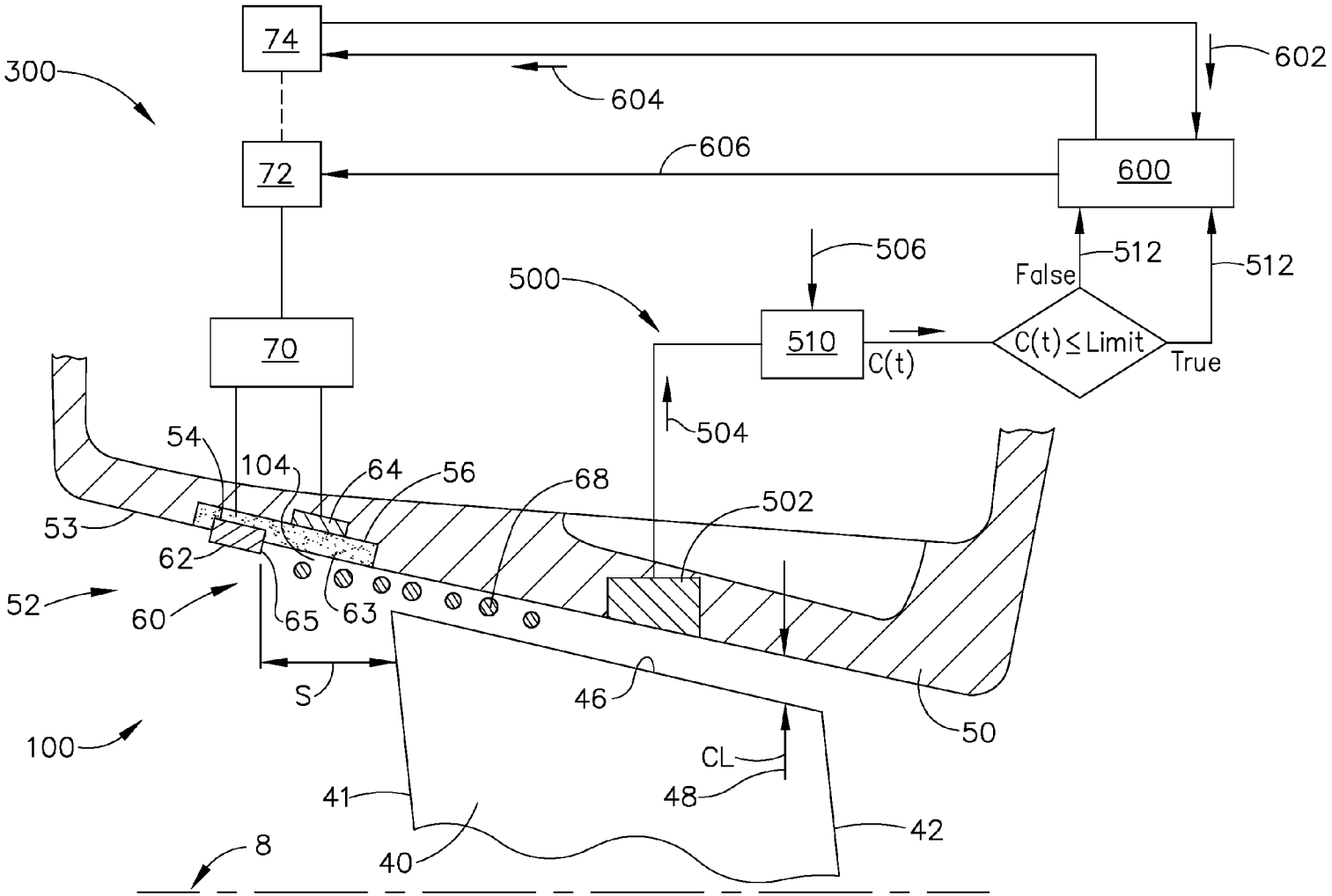
FIG. 6 is a schematic sketch of an exemplary arrangement of a sensor and plasma actuator in an instability mitigation system.

During engine operation, there is an effective clearance CL between the fan blade tip and the casing 50 or the shroud 51 (see FIGS. 5 and 6). The sensor 502 is capable of generating an input signal 504 in real time corresponding to a flow parameter, such as the dynamic pressure in the blade tip region 52 near the blade tip 46. A suitable high response transducer, having a response capability higher than the blade passing frequency is used. Typically these transducers have a response capability higher than 1000 Hz. In the exemplary embodiments shown herein the sensors 502 used were made by Kulite Semiconductor Products. The transducers have a diameter of about 0.1 inches and are about 0.375 inches long. They have an output voltage of about 0.1 volts for a pressure of about 50 pounds per square inch. Conventional signal conditioners are used to amplify the signal to about 10 volts. It is preferable to use a high frequency sampling of the dynamic pressure measurement, such as for example, approximately ten times the blade passing frequency.

The flow parameter measurement from the sensor 502 generates a signal that is used as an input signal 504 by a correlation processor 510. The correlation processor 510 also receives as input a fan rotor speed signal 506 corresponding to the rotational speeds of the fan rotors 12*a*, 12*b*, 12*c*, as shown in FIGS. 1, 2 and 5. In the exemplary embodiments shown herein, the fan rotor speed signal 506 is supplied by an engine control system 74, that is used in gas turbine engines. Alternatively, the fan rotor speed signal 506 may be supplied by a digital electronic control system or a Full Authority Digital Electronic Control (FADEC) system used an aircraft engine.

The correlation processor 510 receives the input signal 504 from the sensor 502 and the rotor speed signal 506 from the control system 74 and generates a stability correlation signal 512 in real time using conventional numerical methods. Auto correlation methods available in the published literature may be used for this purpose. In the exemplary embodiments shown herein, the correlation processor 510 algorithm uses the existing speed signal from the engine control system 74 for cycle synchronization. The correlation measure is computed for individual pressure transducers 502 over rotor blade tips 46 of the rotors 12*a*, 12*b*, 12*c* and input signals 504*a*, 504*b*, 504*c*. The auto-correlation system in the exemplary embodiments described herein sampled a signal from a pressure sensor 502 at a frequency of 200 KHz. This relatively high value of sampling frequency ensures that the data is sampled at a rate at least ten times the fan blade 40 passage frequency. A window of seventy two samples was used to calculate the auto-correlation having a value of near unity along the operating line 116 and dropping towards zero when the operation approached the stall/surge line 112 (see FIG. 3). For a particular fan stage 12*a*, 12*b*, 12*c* when the stability margin approaches zero, the particular fan stage is on the verge of stall and the correlation measure is at a minimum. In the exemplary instability mitigation system 700 (see FIG. 7) disclosed herein designed to avoid an instability such as a stall or surge in a compression system, when the correlation measure drops below a selected and pre-set threshold level, an instability control system 600 receives the stability correlation signal 512 and sends an electrical signal 602 to the engine control system 74, such as for example a FADEC system, and an electrical signal 606 to an electronic controller 72, which in turn can take corrective action using the available control devices to move the engine away from instability such as a stall or surge by raising the stall line as described herein. The methods used by the correlation processor 510 for gauging the aerodynamic stability level in the exemplary embodiments shown herein is described in the paper, "*Development and Demonstration of a Stability Management System for Gas Turbine Engines*", Proceedings of GT2006 ASME Turbo Expo 2006, GT2006-90324.

FIG. 5 shows schematically an exemplary embodiment of the present invention using a sensor 502 located in a casing 50 near the blade tip mid-chord of a blade 40. The sensor is located in the casing 50 such that it can measure the dynamic pressure of the air in the clearance 48 between a fan blade tip 46 and the inner surface 53 of the casing 50. In one exemplary embodiment, the sensor 502 is located in an annular groove 54 in the casing 50. In other exemplary embodiments, it is possible to have multiple annular grooves 54 in the casing 50, such as for example, to provide for tip flow modifications for stability. If multiple grooves are present, the pressure sensor 502 is located within one or more of these grooves, using the same principles and examples disclosed herein. Although the sensor is shown in FIG. 5 as located in a casing 50, in other embodiments, the pressure sensor 502 may be located in a shroud 51, shown in FIG. 10, that is located radially outwards and apart from the blade tip 46. The pressure sensor 502 may also be located in a casing 50 (or shroud 51) near the leading edge 41 tip or the trailing edge 42 tip of the blade 40.

FIG. 7 shows schematically an exemplary embodiment of the present invention using a plurality of sensors 502 in a fan stage, such as item 40*a* in FIG. 2. The plurality of sensors 502 are arranged in the casing 50 (or shroud 51) in a circumferential direction, such that pairs of sensors 502 are located substantially diametrically opposite. The correlations processor 510 receives input signals 504 from these pairs of sensors and processes signals from the pairs together. The differences in the measured data from the diametrically opposite sensors in a pair can be particularly useful in developing stability correlation signal 512 to detect the onset of a fan stall due to engine inlet flow distortions.

Figure 4A:
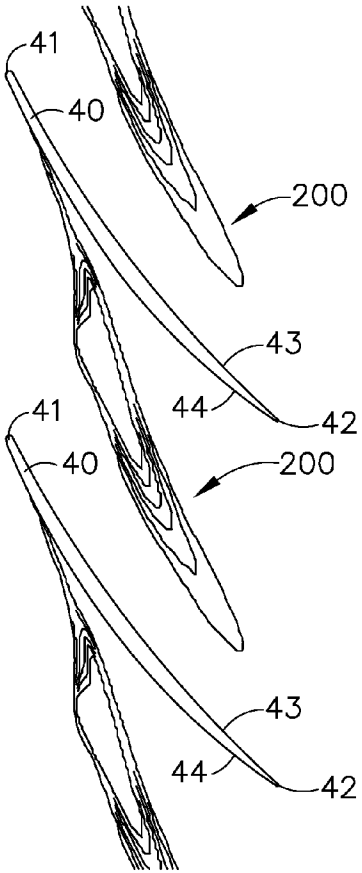
FIG. 4*a* shows the formation of a region of reversed flow in a blade tip vortex in a compression stage as the compressor is throttled above the operating line.

FIGS. 5 and 6 show an exemplary embodiment of a mitigation system 300 that facilitates the improvement of the stability of a compression system when an instability is detected by the detection system 500 as described previously. These exemplary embodiments of the invention use plasma actuators disclosed herein to delay the onset and growth of the blockage by the rotor blade tip leakage vortex 200 as shown in FIGS. 4*a*, 4*b* and 4*c*. The plasma actuators as applied and operated according to the exemplary embodiments of the present invention provide increased axial momentum to the fluid in the tip region 52. The plasma created in the tip region, as described below, strengthens the axial momentum of the fluid and minimizes the negative flow region 200 and also keeps it from growing into a large region of blockage. Plasma actuators used as shown in the exemplary embodiments of the present invention, produce a stream of ions and a body force that act upon the fluid in the tip vortex region, forcing it to pass through the blade passage in the direction of the desired fluid flow. The terms "plasma actuators" and "plasma generators" as used herein have the same meaning and are used interchangeably.

FIG. 6 schematically illustrates, in cross-section view, exemplary embodiments of plasma actuator systems 100 for improving the stability of compression systems. The exemplary embodiments shown herein facilitate an increase in stall margin and/or enhance the efficiency of compression systems in a gas turbine engine 10 such as the aircraft gas turbine engine illustrated in cross-section in FIG. 1. The exemplary gas turbine engine plasma actuator system 100 shown in FIG. 6 includes an annular casing 50, or annular shroud segments 51 (see FIG. 10), surrounding rotatable blade tips 46. An annular plasma generator 60 is located on the casing 50, or the shroud segments 51, in annular grooves 54 or groove segments 56 spaced radially outward from the blade tips 46. The exemplary embodiment shown in FIG. 6 comprises a 1 plasma actuator 60 located in the casing 50 near the tip 46 of the lead edge 41 of the blade 40. Alternately, the plasma actuator 60 may be located in the casing at a location axially aft from the blade leading edge tip, such as for example, at approximately the blade mid-chord.

Figure 10:
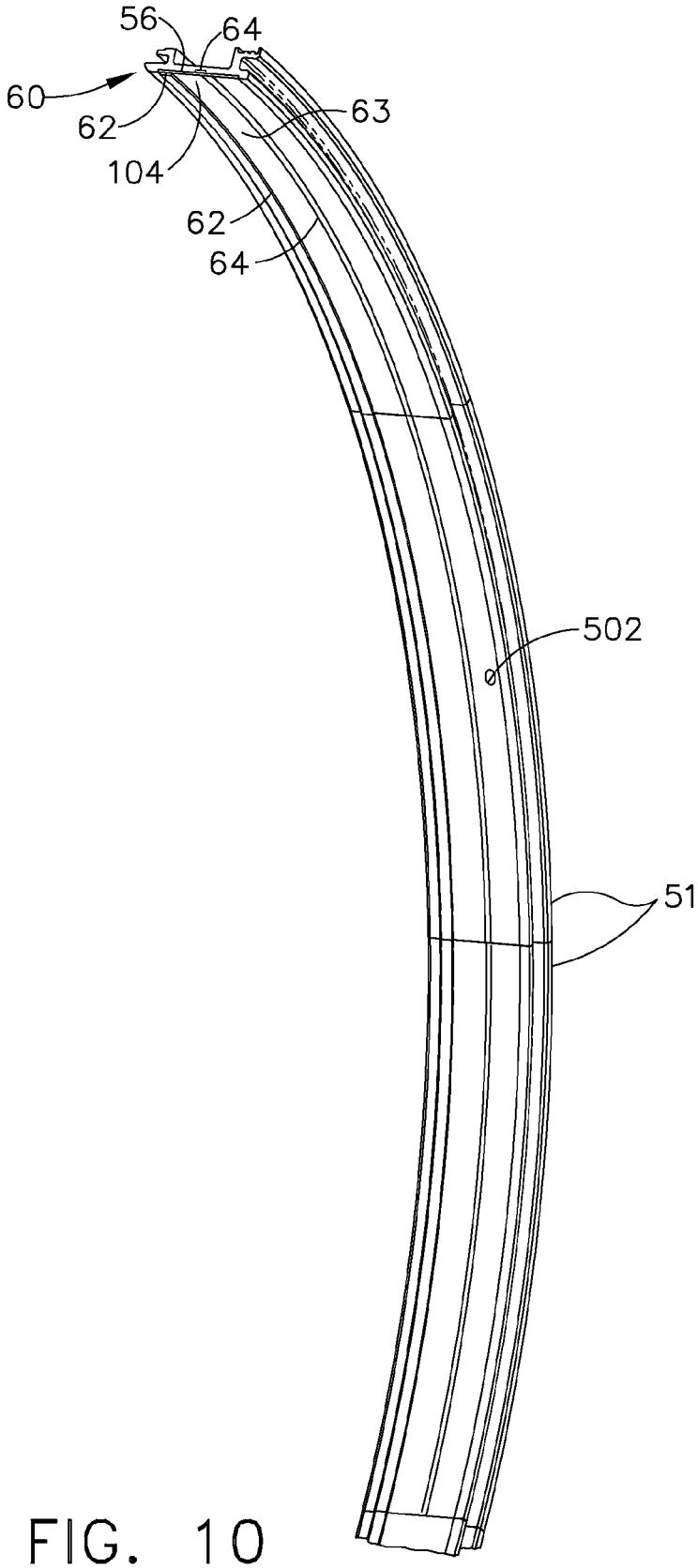
FIG. 10 is an isometric view of a shroud segment of a compression system with an exemplary arrangement of a plasma generator in an exemplary embodiment of the present invention.

FIG. 6 shows an exemplary embodiment of a mitigation system 300 having a plasma actuator system 100 for increasing the stall margin and/or for enhancing the efficiency of a compression system. The term "compression system" as used herein includes devices used for increasing the pressure of a fluid flowing through it, and includes the high pressure compressor 18, the booster and the fan 12 used in gas turbine engines shown in FIG. 1. The exemplary embodiment shown in FIG. 6 shows an annular plasma generator 60 mounted to the casing 50 and includes a first electrode 62 and a second electrode 64 separated by a dielectric material 63. The dielectric material 63 is disposed within an annular groove 54 in a radially inwardly facing surface 53 of the casing 50. In some gas turbine engine designs, some of the stages of the fan 12 or compressor 18 may have annular shroud segments 51 surrounding the blade tips. FIG. 10 shows an exemplary embodiment using plasma actuators in shroud segments 51. As shown in FIG. 10, each of the shroud segments 51 includes an annular groove segment 56 with the dielectric material 63 disposed within the annular groove segment 56. This annular array of groove segments 56 with the dielectric material 63, first electrodes 62 and second electrodes 64 disposed within the annular groove segments 56 forms the annular plasma generator 60.

An AC (alternating current) power supply 70 is connected to the electrodes to supply a high voltage AC potential in a range of about 3-20 kV to the electrodes 62, 64. When the AC amplitude is large enough, the air ionizes in a region of largest electric potential forming a plasma 68. The plasma 68 generally begins near an edge 65 of the first electrode 62 which is exposed to the air and spreads out over an area 104 projected by the second electrode 64 which is covered by the dielectric material 63. The plasma 68 (ionized air) in the presence of an electric field gradient produces a force on the ambient air located radially inwardly of the plasma 68 inducing a virtual aerodynamic shape that causes a change in the pressure distribution over the radially inwardly facing surface 53 of the annular casing 50 or shroud segment 51. The air near the electrodes is weakly ionized, and usually there is little or no heating of the air.

FIG. 7 shows schematically an exemplary embodiment of an instability mitigation system 700 according to the present invention. The exemplary instability mitigation system 700 comprises a detection system 500, a mitigation system 300, a control system 74 for controlling the detection system 500 and the mitigation system 300, including an instability control system 600. The detection system 500, which has one or more sensors 502 to measure a flow parameter such as dynamic pressures near blade tip, and a correlations processor 510, has been described previously herein. The correlations processor 510 sends a correlations signals 512 indicative of whether an onset of an instability such as a stall has been detected at a particular rotor stage, or not, to the instability control system 600, which in turn feeds back status signals 604 to the control system 74. The control system 74 supplies information signals 506 related to the compression system operations, such as rotor speeds, to the correlations processor 510. When an onset of an instability is detected and the control system 74 determines that the mitigation system 300 should be actuated, a command signal 602 is sent to the instability control system 600, which determines the location, type, extent, duration etc. of the instability mitigation actions to be taken and sends the corresponding instability control system signals 606 to the electronic controller 72 for execution. The electronic controller 72 controls the operations of the plasma actuator system 100 and the power supply 70. These operations described above continue until instability mitigation is achieved as confirmed by the detection system 500. The operations of the mitigation system 300 may also be terminated at predetermined operating points determined by the control system 74.

In an exemplary instability mitigation system 700 system in a gas turbine engine 10 shown in FIG. 1, during engine operation, when commanded by the instability control system 600 and an electronic controller 72, the plasma actuator system 100 turns on the plasma generator 60 (see FIGS. 6 and 7) to form the annular plasma 68 between the annular casing 50 or shroud 51 and blade tips 46. The electronic controller 72 can also be linked to an engine control system 74, such as for example a Full Authority Digital Electronic Control (FADEC), which controls the fan speeds, compressor and turbine speeds and fuel system of the engine. The electronic controller 72 is used to control the plasma generator 60 by turning on and off of the plasma generator 60, or otherwise modulating it as necessary to enhance the compression system stability by increasing the stall margin or enhancing the efficiency of the compression system. The electronic controller 72 may also be used to control the operation of the AC power supply 70 that is connected to the electrodes to supply a high voltage AC potential to the electrodes.

In operation, when turned on, the plasma actuator system 100 produces a stream of ions forming the plasma 68 and a body force which pushes the air and alters the pressure distribution near the blade tip on the radially inwardly facing surface 53 of the annular casing 50. The plasma 68 provides a positive axial momentum to the fluid in the blade tip region 52 where a vortex 200 tends to form in conventional compression systems as described previously and as shown in FIGS. 4*a*, 4*b* and 4*c*. The positive axial momentum applied by the plasma 68 forces the air to pass through the passage between adjacent blades, in the desired direction of positive flow, avoiding the type of flow blockage shown in FIG. 4*c* for conventional engines. This increases the stability of the fan or compressor rotor stage and hence the compression system. Plasma generators 60, such as for example, shown in FIG. 6, may be located around the tip of some selected fan or compressor rotor stages where stall is likely to occur. Alternatively, plasma generators may be located around tips of all the compression stages and selectively activated by the instability control system 600 during engine operation using the engine control system 74 or the electronic controller 72.

Plasma generators 60 may be placed axially at a variety of axial locations with respect to the blade leading edge 41 tip. They may be placed axially upstream from the blade leading edge 41 (see FIG. 6 for example). They may also be placed axially downstream from the leading edge 41 (see item marked "S" in FIGS. 8 and 9). Plasma generators are effective when placed in axial locations from about 10% blade tip chord upstream from the leading edge 41 to about 50% blade tip chord downstream from the leading edge 41. They are most effective when they can act directly upon the low momentum fluid associated with the tip vortex 200 such as, for example, shown in FIG. 4*a*. It is preferable to place the plasma generator such that plasma 68 stream influence started at about 10% blade tip chord, where the vortex is seen to start its growth, as shown in FIG. 4*a*. It is more preferable to locate the plasma generators at locations from about 10% chord aft of the leading edge 41 to about 50% chord.

Figure 8:
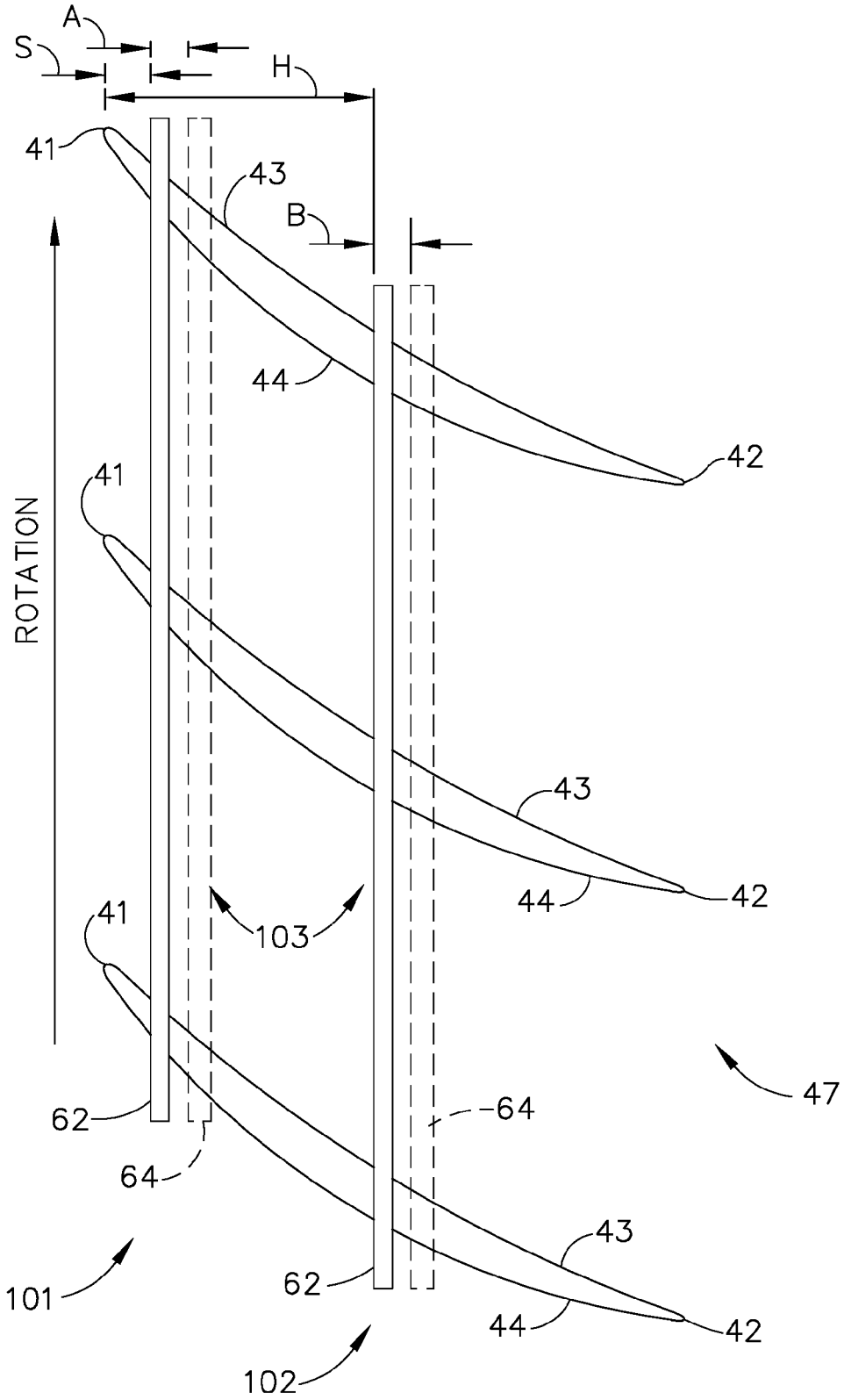
FIG. 8 is a schematic top view of the blade tips of a rotor stage in a compression system with an exemplary arrangement of plasma generators in an exemplary embodiment of the present invention.
Figure 9:
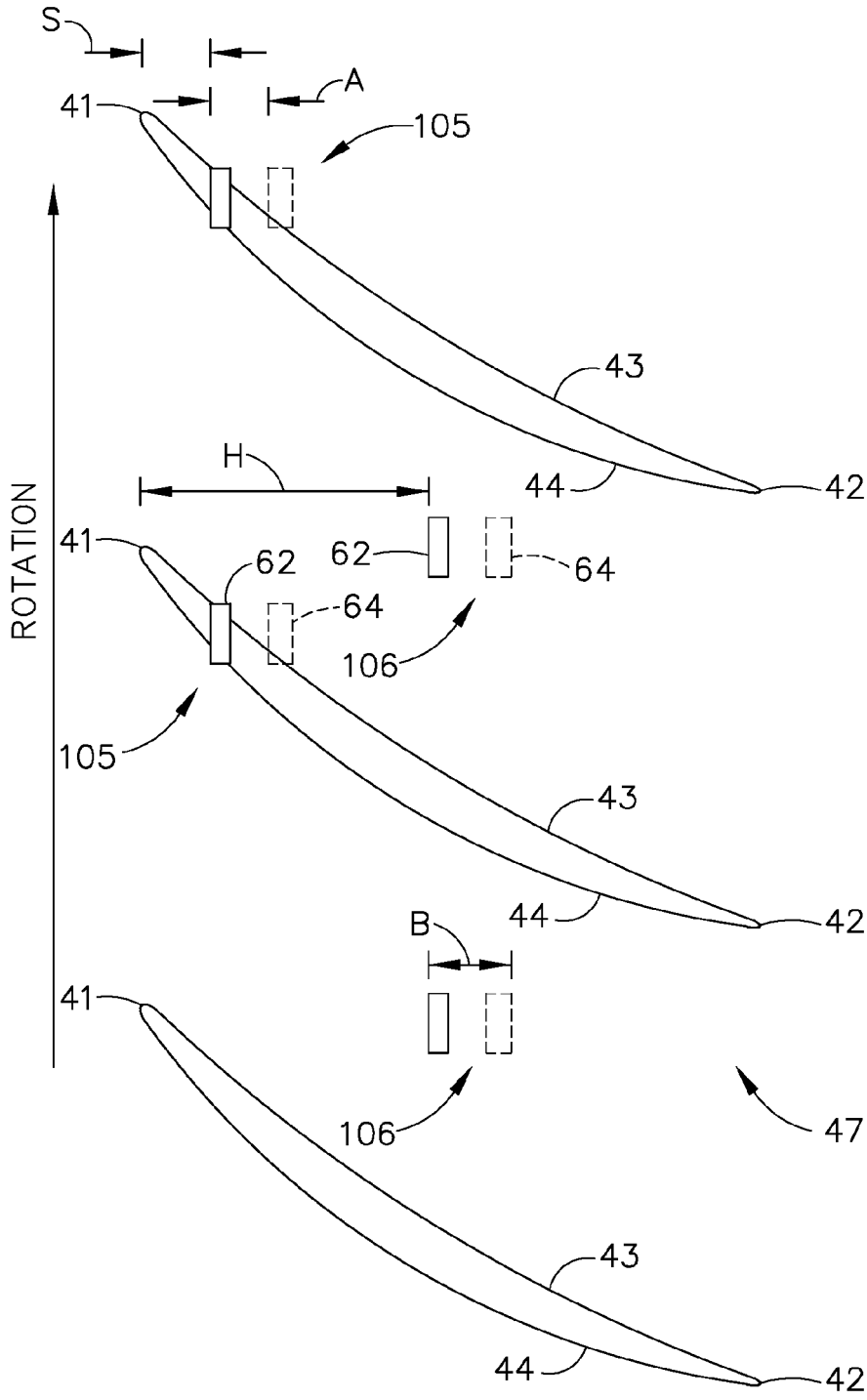
FIG. 9 is a schematic top view of the blade tips of a rotor stage in a compression system with an exemplary arrangement of plasma generators in an exemplary embodiment of the present invention.

In other exemplary embodiments of the present invention, it is possible to have multiple plasma actuators 101, 102 placed at multiple locations in the compressor casing 50 or the shroud segments 51. Exemplary embodiments of the present inventions having multiple plasma actuators at multiple locations are shown in FIGS. 8 and 9. FIG. 8 shows, schematically, an annular lead edge plasma actuator 101 located near the lead edge 41 and an annular part-chord plasma actuator 102 located near the mid-chord of the blade tips 46. In the exemplary embodiment shown in FIG. 8, the plasma actuators 101, 102 form a continuous annular loop 103 within the casing 50. The first electrodes 62 and the second electrodes 64 form continuous loops and are located axially apart by distances A and B that are selected based on the analyses of vortex formation using CFD analyses, such as for example shown in FIGS. 4*a* and 4*b*. The axial location of the lead edge plasma actuator 101 from the blade lead edge tip location ("S") and the axial location of the part-chord actuator 102 form the blade tip location ("H") are also chosen based on the CFD analyses of tip vortex formation. It has been determined that for the exemplary embodiments disclosed herein, it is best to place the lead edge plasma actuator 101 axially at about 10% rotor blade tip chord from the blade lead edge tip ("S"). The part-chord plasma actuator 102 may be placed axially between about 20% to 50% of the rotor blade tip chord from the blade lead edge tip ("H"). In a preferred embodiment, the value for "S" is about 10% rotor blade tip chord and the value for "H" is about 50% rotor blade tip chord.

In another exemplary embodiment shown in FIG. 9, discrete plasma actuators 105, 106 are arranged circumferentially in the casing 50 or the shroud segments 51. The number of discrete actuators 105 and 106 that are needed at a particular compression stage is based on the number blade counts used in that compression stage. In one exemplary embodiment, the number of discrete actuators 105, 106 used is the same as the number of blades in the compression stage and the circumferential spacing between the plasma actuators is the same as the blade row pitch. The axial locations and distances, S, H, A and B, and of the plasma actuators are selected as discussed previously herein in the case of continuous plasma actuators. The discrete plasma actuators, such as for example shown in FIG. 9, may also be arranged such that the plasma 68 is directed at an angle to the engine centerline axis 8. This may be accomplished, for example, by placing second electrode 64 of a discrete plasma actuator relative to the first electrode 62 such that the plasma 68 generated is directed at an angle relative to the engine centerline axis 8. It may be beneficial at some operating conditions to orient the plasma actuators to encourage the flow near the blade tip 46 to orient substantially in the same rotor-relative direction as the main body of flow through the blade passage. In one exemplary embodiment, this is achieved by locating the second electrode 64 of the plasma actuator 60 axially downstream of, and circumferentially offset from, the first electrode 62 such that they lie along substantially the same angle as the average rotor-relative flow direction at a selected operating condition.

In another aspect of the present invention and its exemplary embodiments disclosed herein, the plasma actuators may also be used so as to improve the efficiency of the compression system. It is commonly known to those skilled in the art that there is a very high degree of loss of momentum and increased entropy associated with leakage flows across compressor rotor blade 40 tips 46. Reducing such tip leakage will help reduce losses and improve compression system efficiency. Additionally, modifying the tip leakage flow directions and causing it to mix with the main fluid flow in the compressor at an angle closer to the main flow direction, will help reduce losses and improve compressor efficiency. Plasma actuators mounted on the compressor case 50 or the shroud segments 51 and used as disclosed herein accomplish these goals of reducing blade tip leakage flows and re-orienting it. In order to reduce tip leakage, the plasma actuator 60 is mounted near the blade tip chordwise point where the maximum difference in pressure exists between the blade pressure side 43 and suction side 44 static pressures. In the exemplary embodiments shown herein, that location is approximately at about 10% chord at blade tip. The location of the point of maximum static pressure difference at blade tip can be determined using CFD, as is well known in the industry. When turned on, the plasma actuators have a three-fold effect on the tip leakage flow. First, as in the stall margin enhancement application, the plasma created by the plasma generator 60 induces a positive axial body force on the tip leakage flow, thereby encouraging it to exit the rotor tip region 52 before high loss blockage is created. Second, the plasma generator 60 re-orients the tip leakage flow and causes it to mix with the main fluid flow at a more favorable angle to reduce loss. It is known that loss level in compression systems is a function of the angle between the streams of mixing fluid. Third, the plasma generator 60 reduces the effective flow area for the tip leakage flow and thereby leakage flow rate. Operating the plasma actuators 101, 102, 105, 106 on the casing 50 or shroud segments 51 above the compressor rotor blade tip 46 as shown in FIGS. 6, 8 and 9 creates a force that pushes the air in the tip region both in the axial direction and away from the rotor casing 51 and shroud segments 51. The effect of the plasma 68 pushing the boundary layer on the casing 51 and shroud segments 51 down into the tip clearance region causes the rotor blade 40 to run with a tighter effective tip clearance CL (see FIG. 6) and reduces the effective leakage flow area. This is especially valuable in axial flow compressors, where the low momentum fluid in the tip region is working against an adverse pressure gradient wherein the static pressure rises as air progresses through the axial compressor. In conventional compressors, this adverse pressure gradient works against the low momentum fluid in the tip vortex region and causes it to flow in the opposite direction, resulting in higher losses/low efficiency. The plasma actuators installed and used as disclosed herein facilitates the reduction of these adverse effects of the adverse pressure gradients at the blade tips.

The plasma actuator systems disclosed herein can be operated to effect an increase in the stall margin of the compression systems in the engine by raising the stall line, such as for example shown by the enhanced stall line 113 in FIG. 3. Although it is possible to operate the plasma actuators continuously during engine operation, it is not necessary to operate the plasma actuators continuously to improve the stall margin. At normal operating conditions, blade tip vortices and small regions of reversed flow 200 (see FIG. 4*a*) still exist in the rotor tip region 52. It is first necessary to identify the fan or compressor operating points where stall is likely to occur. This can be done by conventional methods of analysis and testing and results can be represented on an operating map, such as for example, shown in FIG. 3. Referring to FIG. 3, at normal operating points on the operating line 116, for example, the stall margins with respect to the stall line 112 are adequate and the plasma actuators need not be turned on. However, as the compression system is throttled such as for example along the constant speed line 122, or during severe inlet air flow distortions, the axial velocity of the air in the compression system stage over the entire blade span from the blade root 45 to the blade tip 46 decreases, especially in the tip region 52. This axial velocity drop, coupled with higher pressure rise in the rotor blade tip 46, increases the flow over the rotor blade tip and the strength of the tip vortex, creating the conditions for a stall to occur. As the compression system operation approaches conditions that are typically near stall the stall line 112, the plasma actuators are turned on. The plasma actuators are turned on by the instability control system 600 based on the detection system 500 input when the measurements and correlations analyses from the detection system 500 indicate an onset of an instability such as a stall or surge. The control system 74 and/or the electronic controller is set to turn the plasma actuator system on well before the operating points approach the stall line 112 where the compressor is likely to stall. It is preferable to turn on the plasma actuators early, well before reaching the stall line 112, since doing so will increase the absolute throttle margin capability. However, there is no need to expend the power required to run the actuators when the compressor is operating at healthy, steady-state conditions, such as on the operating line 116.

Alternatively, instead of operating the plasma actuators 101, 102, 104, 105 in a continuous mode as described above, the plasma actuators can be operated in a pulsed mode. In the pulsed mode, some or all of the plasma actuators 101, 102, 105, 106 are pulsed on and off at ("pulsing") some predetermined frequencies. It is known that the tip vortex that leads to a compressor stall generally has some natural frequencies, somewhat akin to the shedding frequency of a cylinder placed into a flow stream. For a given rotor geometry, these natural frequencies can be calculated analytically or measured during tests using unsteady flow sensors. These can be programmed into the operating routines in a FADEC or other engine control systems 74 or the electronic controller 72 for the plasma actuators. Then, the plasma actuators 101, 102, 105, 106 can be rapidly pulsed on and off by the control system at selected frequencies related, for example, to the vortex shedding frequencies or the blade passing frequencies of the various compressor stages. Alternatively, the plasma actuators can be pulsed on and off at a frequency corresponding to a "multiple" of a vortex shedding frequency or a "multiple" of the blade passing frequency. The term "multiple", as used herein, can be any number or a fraction and can have values equal to one, greater than one or less than one. The plasma actuator pulsing can be done in-phase with the vortex frequency. Alternatively, the pulsing of the plasma actuators can be done out-of-phase, at a selected phase angle, with the vortex frequency. The phase angle may vary between about 0 degree and 180 degrees. It is preferable to pulse the plasma actuators approximately 180 degrees out-of-phase with the vortex frequency to quickly break down the blade tip vortex as it forms. The plasma actuator phase angle and frequency may selected based on the detection system 500 measurements of the tip vortex signals using probes mounted near the blade tip as described previously herein.

During engine operation, the plasma blade tip clearance control system 90 turns on the plasma generator 60 to form the plasma 68 between the annular casing 50 (or the shroud segments 51) and blade tips 46. An electronic controller 72 may be used to control the plasma generator 60 and the turning on and off of the plasma generator 60. The electronic controller 72 may also be used to control the operation of the AC power supply 70 that is connected to the electrodes 62, 64 to supply a high voltage AC potential to the electrodes 62, 64. The plasma 68 pushes the air close to the surface away from the radially inwardly facing surface 53 of the annular casing 50 (or the shroud segments 51). This produces an effective clearance 48 between the annular casing 50 (or the shroud segments 51) and blade tips 46 that is smaller than a cold clearance between the annular casing 50 (or the shroud segments 51) and blade tips 46. The cold clearance is the clearance when the engine is not running. The actual or running clearance between the annular casing 50 (or the shroud segments 51) and the blade tips 46 varies during engine operation due to thermal growth and centrifugal loads. When the plasma generator 60 is turned on, the effective clearance 48 (CL) between the annular casing surface 53 and blade tips 46 (see FIG. 5) is smaller than when the actuator is turned off.

The cold clearance between the annular casing 50 (or the shroud segments 51) and blade tips 46 is designed so that the blade tips do not rub against the annular casing 50 (or the shroud segments 51) during high powered operation of the engine, such as, during take-off when the blade disc and blades expand as a result of high temperature and centrifugal loads. The exemplary embodiments of the plasma actuator systems illustrated herein are designed and operable to activate the plasma generator 60 to form the annular plasma 68 during conditions of severe inlet flow distortions or during engine transients when the operating line is raised (see item 114 in FIG. 3) where enhanced stall margins are necessary to avoid a fan or compressor stall, or during flight regimes where clearances 48 have to be controlled such as for example, a cruise condition of the aircraft being powered by the engine. Other embodiments of the exemplary plasma actuator systems illustrated herein may be used in other types of gas turbine engines such as marine or perhaps industrial gas turbine engines.

In a segmented shroud 51 design, the segmented shrouds 51 circumscribe fan, booster or compressor blades 40 and helps reduce the flow from leaking around radially outer blade tips 46 of the compressor blades 40. A plasma generator 60 is spaced radially outwardly and apart from the blade tips 46. In this application on segmented shrouds 51, the annular plasma generator 60 is segmented having a segmented annular groove 56 and segmented dielectric material 63 disposed within the segmented annular groove 56. Each segment of shroud has a segment of the annular groove, a segment of the dielectric material disposed within the segment of the annular groove, and first and second electrodes separated by the segment of the dielectric material disposed within the segment of the annular groove.

The exemplary embodiments of the invention herein can be used in any compression sections of the engine 10 such as a booster, a low pressure compressor (LPC), high pressure compressor (HPC) 18 and fan 12 which have annular casings or shrouds and rotor blade tips.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An instability mitigation system for a rotor, the system comprising:

a detection system comprising a sensor located on a static component spaced radially outwardly and apart from tips of a row of blades arranged circumferentially on the rotor wherein the sensor is capable of generating an input signal corresponding to a flow parameter at a location near the tip of a blade;

a mitigation system that facilitates the improvement of the stability of the rotor when an onset of instability is detected by the detection system;

a control system for controlling the detection system and the mitigation system; and a correlation processor that receives the input signal and a rotor speed signal and generates a stability correlation signal;

wherein the control system comprises a controller that controls an AC potential applied to a first electrode and a second electrode of a plasma generator located on the static component;

wherein the controller controls the AC potential by pulsing the AC potential at a selected frequency; and wherein the controller controls the AC potential by pulsing the AC potential at a frequency that is a multiple of the number blades in the row of blades.

2. An instability mitigation system according to claim 1, further comprising a plurality of plasma generators located on the static component at a plurality of axial locations.

3. The instability mitigation system of claim 1, further comprising a plurality of plasma generators arranged circumferentially around a centerline axis of the static component.

4. An instability mitigation system according to claim 1, wherein the detection system comprises a plurality of sensors arranged circumferentially on the static component around an axis of rotation of the rotor and spaced radially outwardly and apart from the tips of the row of blades.

5. An instability mitigation system for a rotor, the system comprising:

a detection system comprising a sensor located on a static component spaced radially outwardly and apart from tips of a row of blades arranged circumferentially on the rotor wherein the sensor is capable of generating an input signal corresponding to a flow parameter at a location near the tip of a blade;

a mitigation system that facilitates the improvement of the stability of the rotor when an onset of instability is detected by the detection system;

a control system for controlling the detection system and the mitigation system; and a correlation processor that receives the input signal and a rotor speed signal and generates a stability correlation signal;

wherein the control system comprises a controller that controls an AC potential applied to a first electrode and a second electrode of a plasma generator located on the static component;

wherein the controller controls the AC potential by pulsing the AC potential at a selected frequency; and wherein the controller pulses the AC potential in-phase with a multiple of the vortex shedding frequency at the blade tip.

6. An instability mitigation system according to claim 5, further comprising a plurality of plasma generators located on the static component at a plurality of axial locations.

7. The instability mitigation system of claim 5, further comprising a plurality of plasma generators arranged circumferentially around a centerline axis of the static component.

8. An instability mitigation system according to claim 5, wherein the detection system comprises a plurality of sensors arranged circumferentially on the static component around an axis of rotation of the rotor and spaced radially outwardly and apart from the tips of the row of blades.

9. An instability mitigation system for a rotor, the system comprising:

a detection system comprising a sensor located on a static component spaced radially outwardly and apart from tips of a row of blades arranged circumferentially on the rotor wherein the sensor is capable of generating an input signal corresponding to a flow parameter at a location near the tip of a blade;

a mitigation system that facilitates the improvement of the stability of the rotor when an onset of instability is detected by the detection system;

a control system for controlling the detection system and the mitigation system; and a correlation processor that receives the input signal and a rotor speed signal and generates a stability correlation signal;

wherein the control system comprises a controller that controls an AC potential applied to a first electrode and a second electrode of a plasma generator located on the static component;

wherein the controller controls the AC potential by pulsing the AC potential at a selected frequency; and wherein the controller pulses the AC potential out-of-phase with a multiple of the vortex shedding frequency at the blade tip.

10. An instability mitigation system according to claim 9, further comprising a plurality of plasma generators located on the static component at a plurality of axial locations.

11. The instability mitigation system of claim 9, further comprising a plurality of plasma generators arranged circumferentially around a centerline axis of the static component.

12. An instability mitigation system according to claim 9, wherein the detection system comprises a plurality of sensors arranged circumferentially on the static component around an axis of rotation of the rotor and spaced radially outwardly and apart from the tips of the row of blades.

* * * * *